US009431726B2

(12) United States Patent
Tanaka et al.

(10) Patent No.: US 9,431,726 B2
(45) Date of Patent: Aug. 30, 2016

(54) MULTI-CORE CABLE

(71) Applicant: SUMITOMO ELECTRIC INDUSTRIES, LTD., Osaka-shi, Osaka (JP)

(72) Inventors: Masato Tanaka, Kanuma (JP); Takuya Ishikawa, Kanuma (JP); Yoshimasa Watanabe, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 29 days.

(21) Appl. No.: 14/160,953

(22) Filed: Jan. 22, 2014

(65) Prior Publication Data

US 2014/0202729 A1 Jul. 24, 2014

(30) Foreign Application Priority Data

Jan. 22, 2013 (JP) ..... 2013-009453
Nov. 25, 2013 (JP) ..... 2013-006702

(51) Int. Cl.

| | |
|---|---|
| ***H01B 11/08*** | (2006.01) |
| ***H01R 9/03*** | (2006.01) |
| ***H01R 4/02*** | (2006.01) |
| ***H01R 4/14*** | (2006.01) |
| *H01B 11/10* | (2006.01) |

(52) U.S. Cl.

CPC ..... *H01R 9/034* (2013.01); *H01R 4/021* (2013.01); *H01R 4/14* (2013.01); *H01B 11/1091* (2013.01)

(58) Field of Classification Search

CPC ..... H01B 11/20; H01B 7/00; H01B 13/016; H01B 13/012; H01R 9/05; H01R 43/02

USPC ..... 174/88 C, 78, 106 R, 102 SP

See application file for complete search history.

(56) References Cited

U.S. PATENT DOCUMENTS 2,889,394 A * 6/1959 Aune ..... H01R 9/05 174/75 C
3,280,246 A * 10/1966 Lawson ..... H01R 9/038 174/78

(Continued)

FOREIGN PATENT DOCUMENTS

JP 2011-146163 * 7/2011
JP 2011-146163 A 7/2011

(Continued)

OTHER PUBLICATIONS

Zequn Mei et al. Low-Temperature Solders, Aug. 1996 Hewlett-Packard Journal , Article 10.*

(Continued)

*Primary Examiner* — Michael F McAllister

(74) *Attorney, Agent, or Firm* — Drinker Biddle & Reath LLP

(57) ABSTRACT

A multi-core cable 1 includes plural shielded electric wires 10 for signal transmission. The plural shielded electric wires 10 are bundled so as to make contact with the adjacent shielded electric wires 10, and sheaths 14 of the plural shielded electric wires 10 are respectively removed at the same position in the length direction, and outer conductors 13 of the plural shielded electric wires 10 at the position at which the sheaths 14 are removed are bundled by a metal wire 30 and the bundled portion is soldered and fastened.

7 Claims, 10 Drawing Sheets

(56) References Cited

U.S. PATENT DOCUMENTS 4,281,211 A * 7/1981 Tatum ..... H01B 7/083 174/117 F
4,965,410 A * 10/1990 Spector ..... H01R 4/723 174/77 R
5,347,090 A * 9/1994 Cerda ..... H01R 4/04 156/296
5,815,916 A * 10/1998 Luc ..... H01R 43/0256 29/33 M
6,326,549 B1 * 12/2001 Kunii ..... H01R 43/28 174/117 F
6,395,977 B1 * 5/2002 Yamamoto ..... H01R 24/44 174/36
7,373,054 B2 * 5/2008 Stix ..... G02B 6/3816 385/100
2008/0314613 A1 * 12/2008 Huang ..... H01B 7/04 174/107

FOREIGN PATENT DOCUMENTS

JP 2011-165557 * 8/2011
JP 2011-165557 A 8/2011

OTHER PUBLICATIONS

Low-Temperature Solders by Zequn Mei, Helen A. Holder, and Hubert A. Vander Plas Aug. 1996 Hewlett-Packard Journal.*

* cited by examiner

MULTI-CORE CABLE

CROSS-REFERENCE TO RELATED APPLICATIONS

This application is based on and claims priority from Japanese patent application No. 2013-009453 filed on Jan. 22, 2013 and Japanese Utility Model application No. 2013-006702 filed on Nov. 25, 2013, the entire contents of which are incorporated herein by reference.

TECHNICAL FIELD

The present invention relates to a multi-core cable for integrating plural shielded electric wires.

BACKGROUND ART

For example, JP-2011-146163-A discloses that outer conductors of plural shielded electric wires are exposed at given positions and are integrated by solder.

As disclosed in JP-2011-146163-A, when the outer conductor of each of the shielded electric wires is grounded, the assembled portion of the outer conductors is soldered and a diameter of the portion becomes large.

MODE FOR CARRYING OUT THE INVENTION

Figure 1:
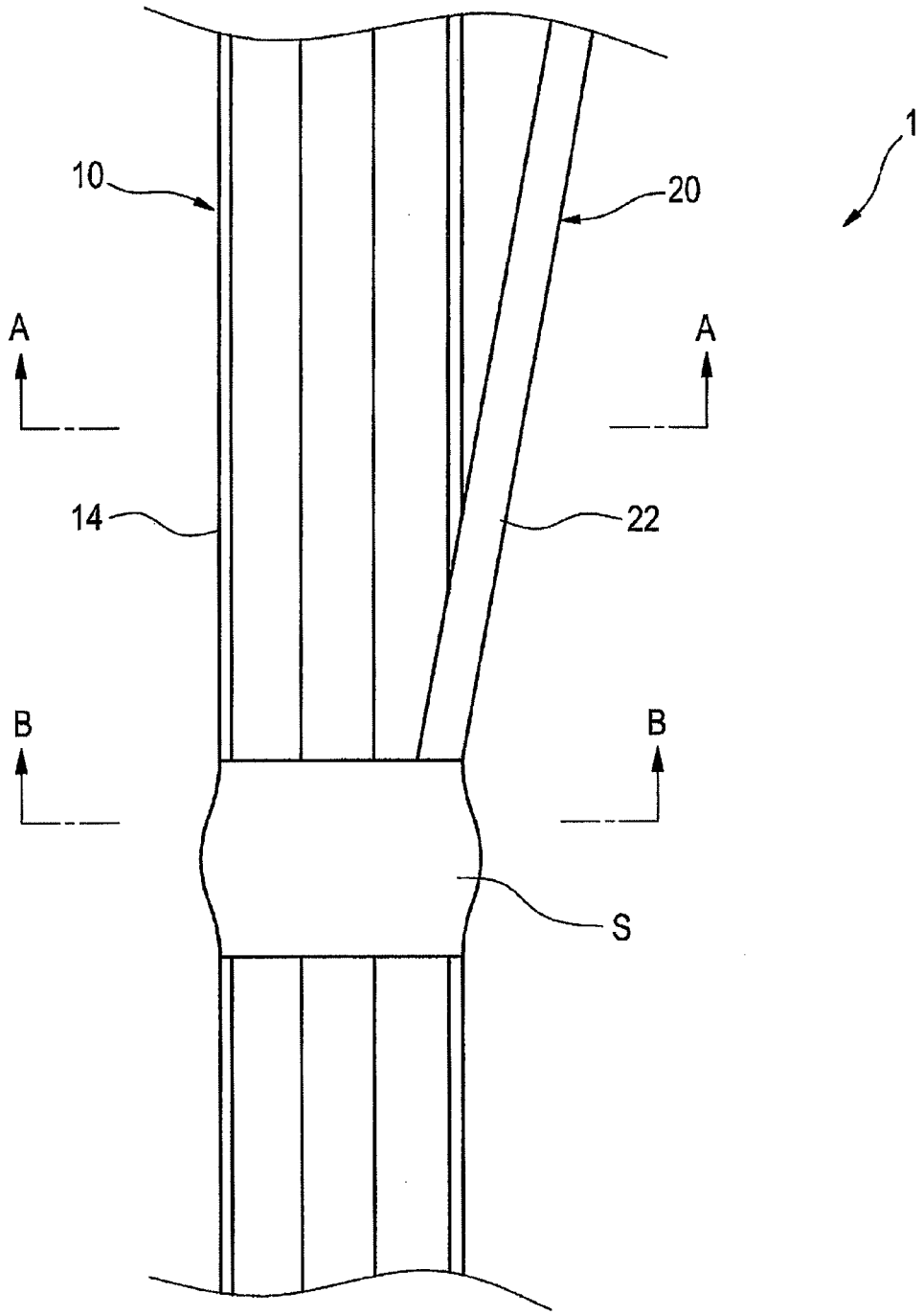
FIG. 1 is a plan view showing one example of an embodiment of a multi-core cable according to the invention.

Description of Embodiment of the Present Invention

First, the contents of embodiments of the present invention will be described.

(1) The invention provides a multi-core cable including plural shielded electric wires for signal transmission, wherein the plural shielded electric wires are bundled so as to make contact with the adjacent shielded electric wires, wherein sheaths of the plural shielded electric wires are respectively removed at the same position in a length direction, and wherein outer conductors of the plural shielded electric wires at the position at which the sheaths are removed are bundled by a metal wire, and the bundled portion is soldered and fastened.

According to the multi-core cable according to the invention, the outer conductors of the shielded electric wires can be bundled by the metal wire to decrease a diameter of the position at which the outer conductors are assembled.

(2) The invention may provide the multi-core cable, wherein the multi-core cable includes a ground electric wire made of an insulated electric wire or a shielded electric wire, wherein a sheath of the ground electric wire is removed to expose a conductor at the same position in the length direction as the position at which the sheaths of the shielded electric wires for signal transmission are removed, and wherein the metal wire winds around the outer conductors of the plural shielded electric wires and the conductor of the ground electric wire to thereby bundle the plural shielded electric wires and the ground electric wire, and the bundled portion is soldered and fastened.

(3) The invention may provide the multi-core cable, wherein the ground electric wire is a shielded electric wire, wherein the sheath of the ground electric wire is removed to expose an outer conductor at the same position in the length direction as the position at which the sheaths of the shielded electric wires for signal transmission are removed, and wherein the metal wire winds around the outer conductors of the plural shielded electric wires and the outer conductor of the ground electric wire to thereby bundle the plural shielded electric wires and the ground electric wire, and the bundled portion is soldered and fastened.

According to the configuration of (2) or (3), a terminal for grounding the ground electric wire can be provided at any position and the grounding position can be designed freely.

(4) The invention may provide the multi-core cable, wherein the plural shielded electric wires are covered with a cable sheath, wherein each shielded electric wire has a central conductor having a cross-sectional area of 0.01 $mm^2$ or less, an insulating layer covering the central conductor, the outer conductor covering the insulating layer, and the sheath covering the outer conductor, wherein, in an end of the multi-core cable, the cable sheath is removed along a given length to expose the plural shielded electric wires, wherein each of the sheaths of the plural shielded electric wires is removed at the same position in the length direction to expose each of the outer conductors, wherein the metal wire wholly winds around the outer conductors so as to tighten and bundle the exposed outer conductors, wherein the position at which the metal wire winds is fastened to each of the outer conductors by solder having a melting temperature of 130 to 150° C., and wherein an outside diameter of the position at which the metal wire winds and the shielded electric wires are fastened by the solder is smaller than an outside diameter of the cable sheath.

According to the configuration of (4), the metal wire tightens and bundles the plural shielded electric wires. As a result, the outside diameter of the position at which the metal wire winds and the shielded electric wires are fastened by the solder can be made smaller than the outside diameter of the multi-core cable, and handleability of the multi-core cable is improved.

Since the outer conductors and the metal wire winding therearound are fastened by the low-melting-point solder having the melting temperature of 130 to 150° C., deterioration of the insulating layer due to heat transferred in the case of soldering can be prevented.

(5) The invention may provide the multi-core cable, wherein the multi-core cable further includes plural insulated electric wires for signal transmission, wherein each insulated electric wire has a central conductor having an area of 0.01 $mm^2$ or less, and a covering covering the central conductor, and wherein the plural insulated electric wires are bundled together with all the outer conductors of the plural shielded electric wires by the metal wire.

According to the configuration of (5), in the multi-core cable including the plural insulated electric wires, the insulated electric wires are bundled together with the shielded electric wires by the metal wire. As a result, handleability of the multi-core cable is improved.

(6) The invention may provide the multi-core cable, wherein the metal wire has an insulating part of an insulating material covering a part of the metal wire, wherein each of the outer conductors is wholly bundled by the metal wire exposed from the insulating part, and wherein the insulating part is arranged in parallel with each of the sheaths.

According to the configuration of (6), the insulating part can mechanically protect the metal wire. The insulating part can also prevent the metal wire from being short-circuited by unnecessarily making contact with the shielded electric wires arranged in parallel.

(7) The invention may provide the multi-core cable, wherein the plural shielded electric wires are covered with a cable sheath, wherein each shielded electric wire has plural central conductors having cross-sectional area of 0.01 $mm^2$ or less, respectively, plural insulating layers covering the plural central conductors, respectively, an outer conductor wholly covering the insulating layers, and a sheath covering the outer conductor, wherein, in an end of the multi-core cable, the cable sheath is removed along a given length to expose the plural shielded electric wires, wherein each of the sheaths of the plural shielded electric wires is removed at the same position in the length direction to expose each of the outer conductors, wherein the metal wire wholly winds around the outer conductors so as to tighten and bundle the exposed outer conductors, wherein the position at which the metal wire winds is fastened to each of the outer conductors by solder having a melting temperature of 130 to 150° C., and wherein an outside diameter of the position at which the metal wire winds and the shielded electric wires are fastened by the solder is smaller than an outside diameter of the cable sheath.

According to the configuration of (7), the metal wire tightens and bundles the plural shielded electric wires. As a result, the outside diameter of the position at which the metal wire winds and the shielded electric wires are fastened by the solder can be made smaller than the outside diameter of the multi-core cable, and handleability of the multi-core cable is improved.

Since the outer conductors and the metal wire winding therearound are fastened by the low-melting-point solder having the melting temperature of 130 to 150° C., deterioration of the insulating layer due to heat transferred in the case of soldering can be prevented.

(8) The invention may provide the multi-core cable, wherein the multi-core cable further includes plural insulated electric wires for signal transmission, wherein each insulated electric wire has a central conductor having a cross-sectional area of 0.01 $mm^2$ or less, and a covering covering the central conductor, and wherein the plural insulated electric wires are bundled together with all the outer conductors of the plural shielded electric wires by the metal wire.

According to the configuration of (8), even for the multi-core cable including the plural insulated electric wires, the insulated electric wires are bundled together with the shielded electric wires by the metal wire. As a result, handleability of the multi-core cable is improved.

Details of Embodiment of the Present Invention

Examples of embodiments of a multi-core cable according to the invention will hereinafter be described with reference to the drawings.

Figure 2:
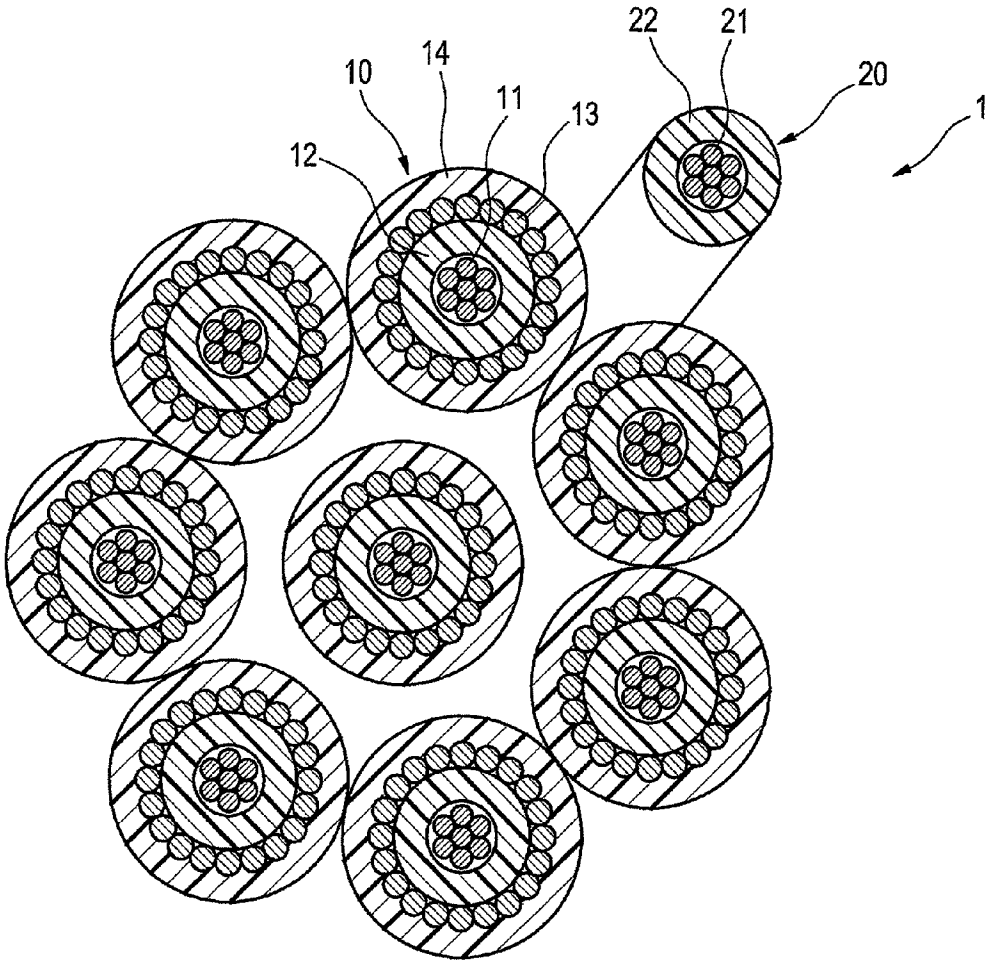
FIG. 2 is an enlarged sectional view taken on line A-A of the multi-core cable shown in FIG. 1.
Figure 3:
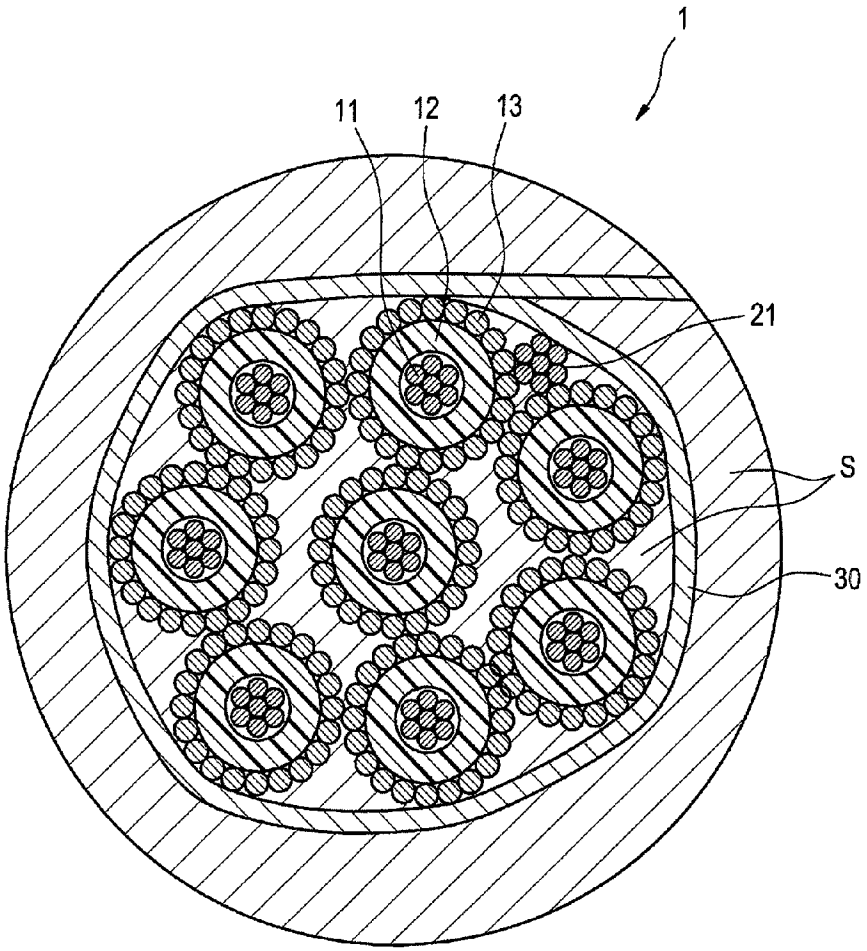
FIG. 3 is an enlarged sectional view taken on line B-B of the multi-core cable shown in FIG. 1.

As shown in FIGS. 1 to 3, a multi-core cable 1 is constructed by assembling plural (eight herein) shielded electric wires 10 for signal transmission and one ground electric wire 20. The eight shielded electric wires 10 are bundled so as to make contact with the adjacent shielded electric wires 10. The shielded electric wires 10 transmit electrical signals or electric power.

As shown in FIG. 2, in the case of the eight shielded electric wires 10, the shielded electric wires 10 are bundled so as to round the outer periphery of the bundled shielded electric wires 10 when viewed in a cross section perpendicular to a length direction of the shielded electric wires 10.

Although the number of shielded electric wires 10 is eight in the present example, the number of shielded electric wires 10 is not limited to eight as long as the number is two or more. In the case of the four shielded electric wires 10, the shielded electric wires 10 are bundled so as to form the outer periphery of the bundled shielded electric wires 10 in a quadrilateral when viewed in the cross section perpendicular to the length direction of the shielded electric wires 10.

As shown in FIG. 2, the shielded electric wire 10 has a central conductor 11, an inner insulator 12, an outer conductor 13 and a sheath 14 from the center toward the outside in a cross section along a radial direction orthogonal to the central axis of the shielded electric wire 10. As the shielded electric wire 10, for example, a shielded electric wire thinner than AWG 40 in conformity with standards of AWG (American Wire Gauge) is desirably used. For example, a shielded electric wire of AWG 46 having an outside diameter of 0.2 mm can be used.

By way of example, the shielded electric wire 10 includes, for example, the central conductor 11 made of a twisted wire formed by twisting plural tin-plated annealed copper wires, the inner insulator 12 made of a fluorine resin such as PFA (tetra fluoroethylene perfluoroalkyl vinyl ether copolymer), the outer conductor 13 made of a copper evaporated polyester tape or copper foil or winding of plural tin-plated annealed copper wires, and the sheath 14 made of polyester, PTFE, etc.

An insulated electric wire can be used as the ground electric wire 20. The ground electric wire 20 of the insulated electric wire has a conductor 21 and a sheath 22 from the center toward the outside. The thickness of the ground electric wire 20 is, for example, AWG 46 (an outside diameter of the conductor portion is 0.05 mm). A shielded electric wire can also be used as the ground electric wire. The ground shielded electric wire may be an electric wire having a configuration different from that of the shielded electric wire.

As shown in FIG. 3, each of the sheaths 14 and the sheath 22 are removed at the same position in a length direction of the multi-core cable 1.

A metal wire 30 winds around the outer conductors 13 of the eight shielded electric wires 10 at the position at which the sheaths 14 are removed and the conductor 21 of the ground electric wire 20 at the position at which the sheath 22 is removed. Accordingly, the eight shielded electric wires 10 and the ground electric wire 20 are bundled.

As the metal wire 30, for example, a tin-plated annealed copper wire gavubg an outside diameter of about 0.08 mm can be used.

The portion in which the outer conductors 13 and the conductor 21 are bundled by the metal wire 30 is fastened by solder S to integrate the outer conductors 13 of the eight shielded electric wires 10 with the conductor 21 of the ground electric wire 20. That is, electrical connection between the outer conductors 13 of the eight shielded electric wires 10 and the conductor 21 of the ground electric wire 20 is provided through the metal wire 30. The shielded electric wires 10 can be grounded to a substrate, a connector, etc. through the metal wire 30.

When a shielded electric wire is used as the ground electric wire, a sheath of the shielded electric wire of the ground electric wire is removed and an outer conductor of the ground electric wire is exposed and is brought into contact with the outer conductors 13 of the shielded electric wires 10, whereby the shielding electric wires 10 and the outer conductors 13 are integrated.

Figure 4:
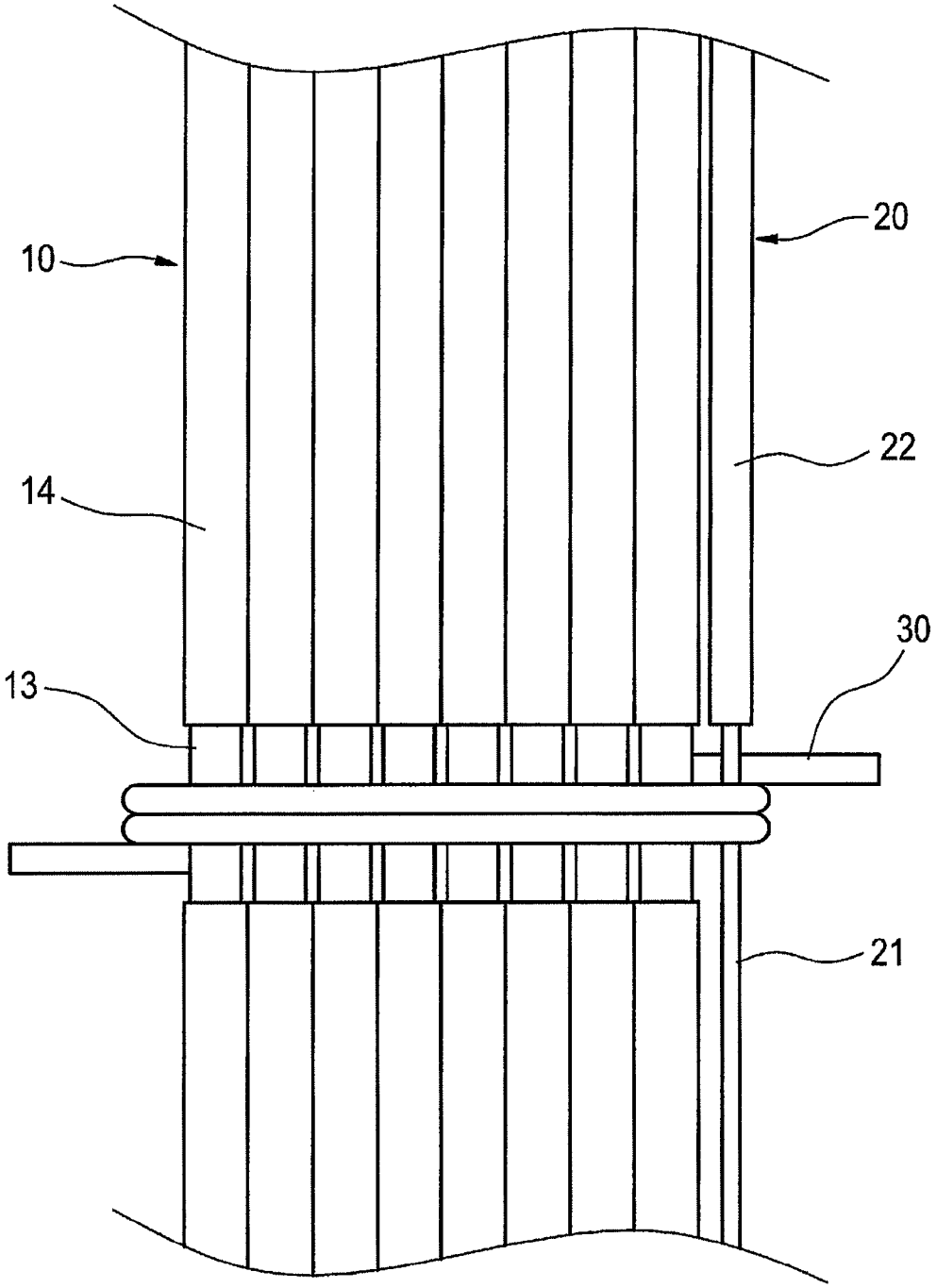
FIG. 4 is a plan view showing a manufacturing method of the multi-core cable according to FIG. 1.

Next, a step of manufacturing the multi-core cable 1 configured as described above will be described with reference to FIGS. 4 to 6.

First, the eight shielded electric wires 10 and the ground electric wire 20 are juxtaposed in line and are fixed by a tape (not shown) etc. Next, in one end side of a group of the shielded electric wires 10 juxtaposed, the sheaths 14 are cut by a $CO_2$ laser etc. Then, the cut sheaths 14 are moved to one end side by, for example, about 1 to 2 mm, and the outer conductors 13 are exposed. Similarly, the sheath 22 of the ground electric wire 20 is cut by a $CO_2$ laser etc., and the sheath 22 of one end side is removed to expose the conductor 21.

The outer conductors 13 and the conductor 21 are exposed at the same position in the length direction of the eight shielded electric wires 10 and the ground electric wire 20.

Subsequently, the metal wire 30 winds around the position at which the outer conductors 13 of the eight shielded electric wires 10 and the conductor 21 of the ground electric wire 20 are exposed. This results in a state shown in FIG. 4.

Figure 5:
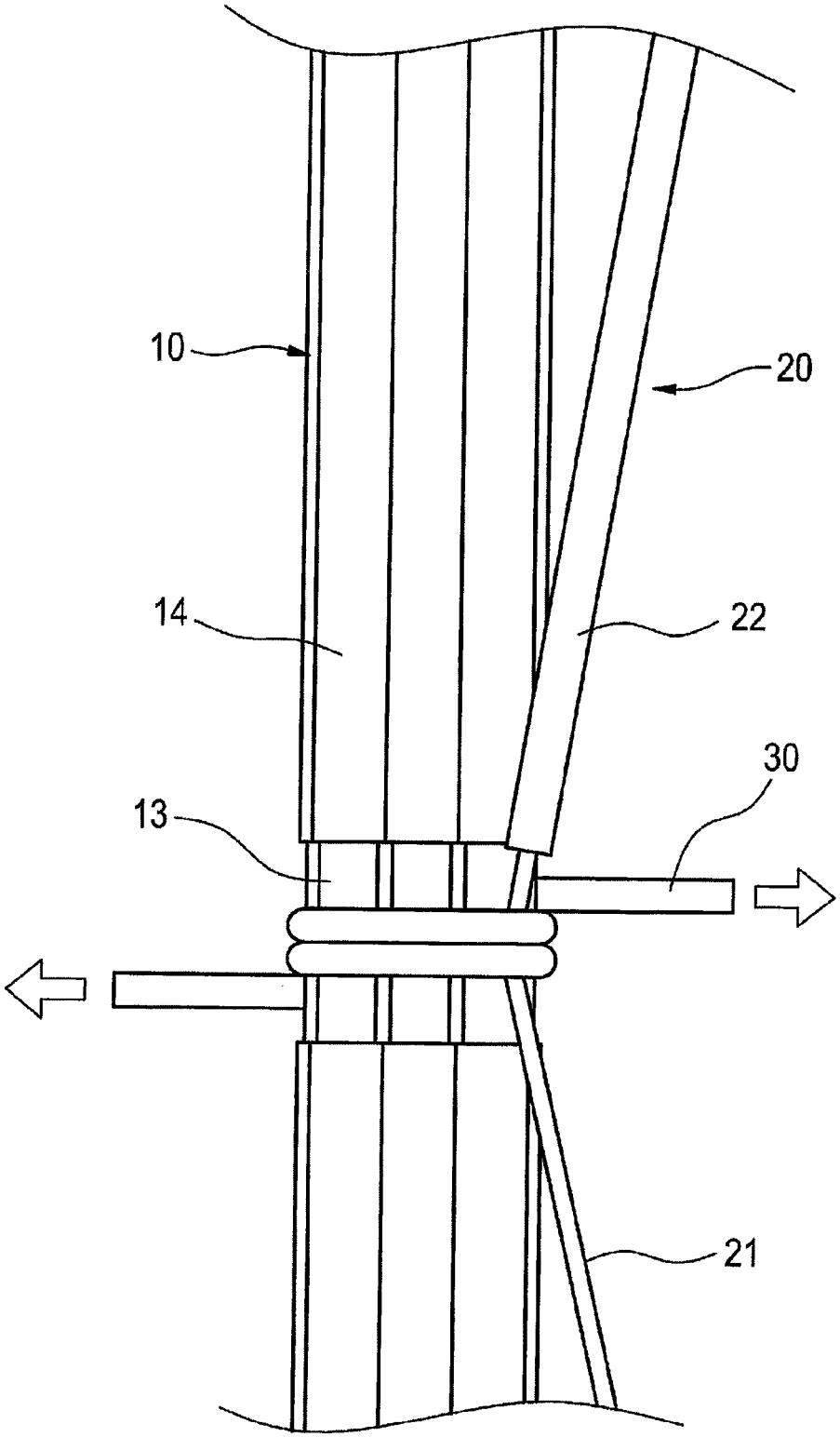
FIG. 5 is a plan view showing the manufacturing method of the multi-core cable according to FIG. 1.

As shown in FIG. 5, the outer conductors 13 and the conductor 21 are tightly bound by strongly pulling the metal wire 30 from side to side (in the direction cross to the length direction). Accordingly, the eight shielded electric wires 10 and the ground electric wire 20 are arranged in a roundly bundled state when viewed in a cross section perpendicular to the length direction.

Figure 6:
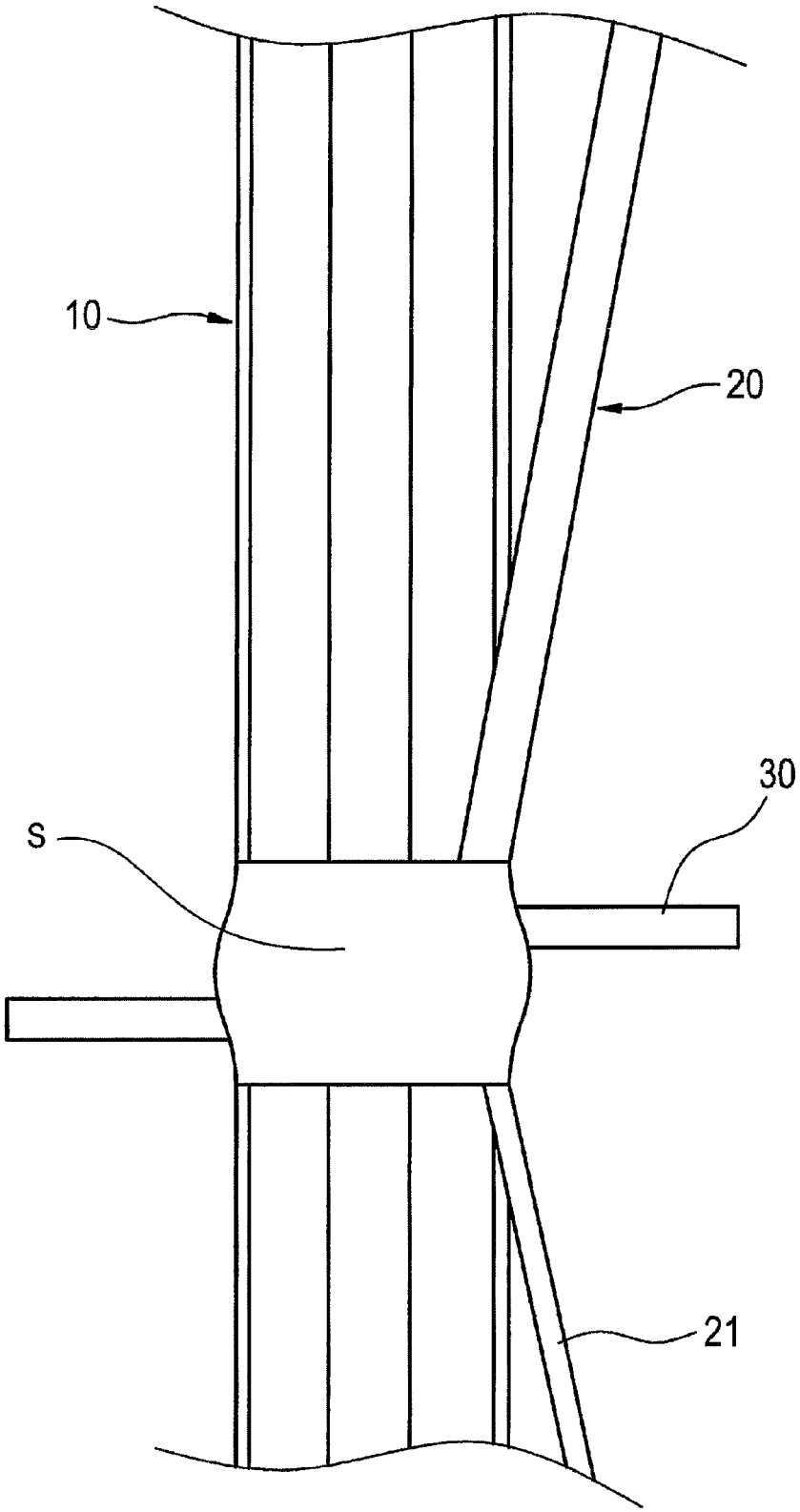
FIG. 6 is a plan view showing the manufacturing method of the multi-core cable according to FIG. 1.

The portion in which the outer conductors 13 and the conductor 21 are bound by the metal wire 30 is immersed in a solder bath of, for example, 260° C. to thereby apply solder S as shown in FIG. 6. In this manner, the eight outer conductors 13 and the conductor 21 are joined and integrated by soldering. The portion in which the outer conductors 13 and the conductor 21 are bound by the metal wire 30 may be immersed in the solder bath of 130 to 150° C. to thereby apply the low-melting-point solder S having a melting temperature of 130 to 150° C.

The multi-core cable 1 shown in FIG. 1 is manufactured by cutting and removing the portion in which the metal wire 30 and the conductor 21 protrude from the solder S.

The multi-core cable 1 according to the embodiment described above has the plural shielded electric wires 10 for signal transmission. The plural shielded electric wires 10 are bundled so as to make contact with the adjacent shielded electric wires 10. The sheaths 14 of the plural shielded electric wires 10 are respectively removed at the same position in the length direction. The outer conductors 13 of the plural shielded electric wires 10 at the position at which the sheaths 14 are removed are bundled by the metal wire 30 and the bundled portion is soldered and fastened.

This enables a decrease in diameter of the position at which the outer conductors 13 of the shielded electric wires 10 are bundled.

The multi-core cable 1 according to the embodiment includes the ground electric wire 20 made of an insulated electric wire or a shielded electric wire. The grounding position of the ground electric wire can be designed freely.

Second Embodiment

Next, a multi-core cable 101 according to a second embodiment will be described.

Figure 7:
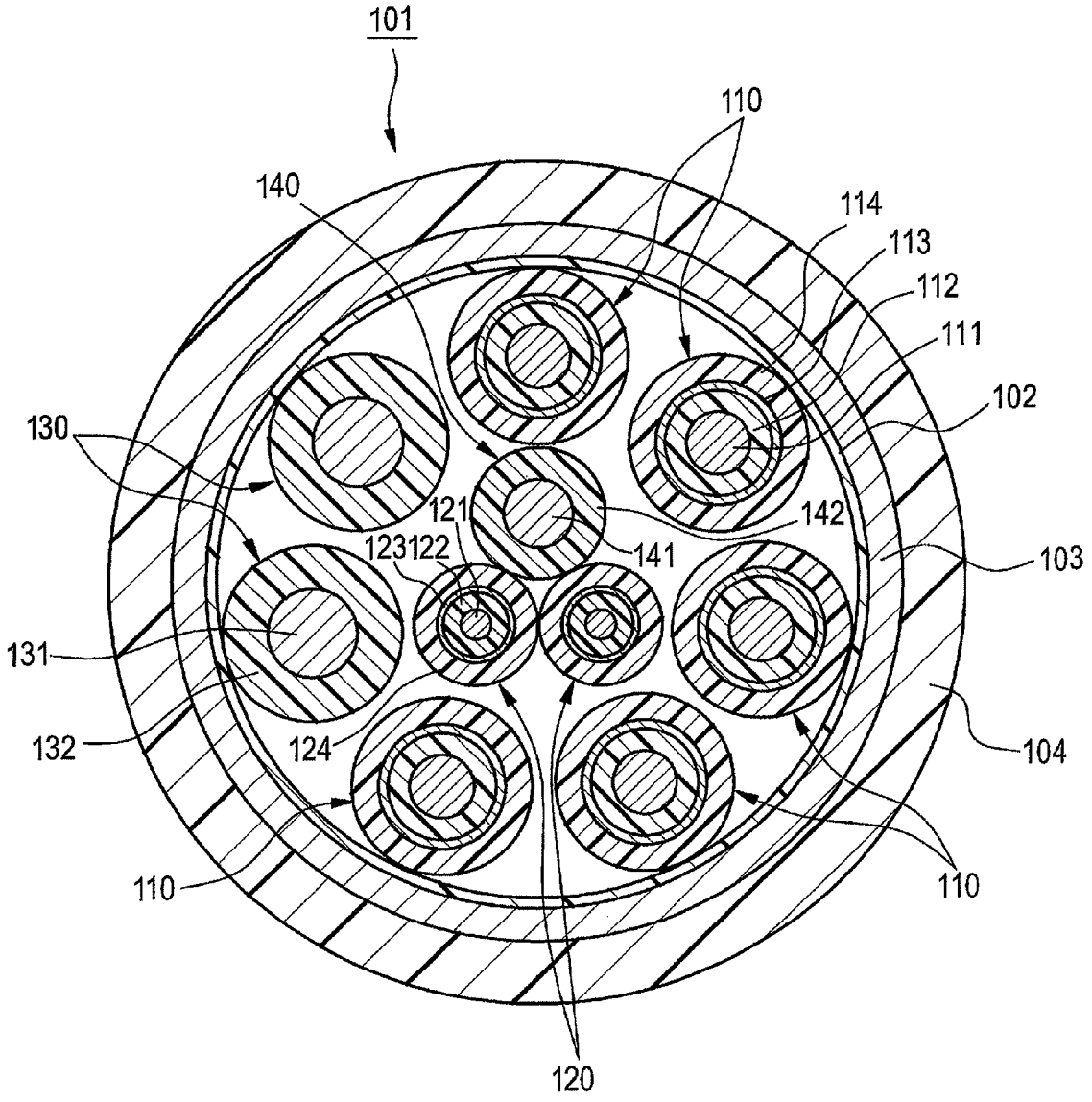
FIG. 7 is a sectional view showing one example of a multi-core cable according to a second embodiment of the invention.

As shown in FIG. 7, the multi-core cable 101 according to the second embodiment has plural shielded electric wires for signal transmission. The shielded electric wires have plural large-diameter shielded electric wires 110 and plural small-diameter shielded electric wires 120. The multi-core cable 101 has plural insulated electric wires for signal transmission. The insulated electric wires have plural large-diameter insulated electric wires 130 and at least one small-diameter insulated electric wire 140. The multi-core cable 101 further includes a wrapping 102 for bundling these electric wires, an overall shielding layer 103 covering the wrapping 102, and a cable sheath 104 covering the overall shielding layer 103.

Each large-diameter shielded electric wire 110 has a central conductor 111, an inner insulator (insulating layer) 112, an outer conductor 113 and a sheath 114 from the center toward the outside in a cross section along the radial direction orthogonal to the central axis.

As the large-diameter shielded electric wire 110, for example, a shielded electric wire of AWG 38 in conformity with standards of AWG (American Wire Gauge), in which a cross-sectional area of the central conductor 111 is, for example, 0.01 $mm^2$ or less, is desirably used.

As the central conductor 111 of the large-diameter shielded electric wire 110, a twisted wire having an outside diameter of, for example, 0.12 mm formed by twisting seven tin-plated annealed copper alloy wires having a diameter of, for example, 0.04 mm is used.

As a material of the inner insulator 112 of the large-diameter shielded electric wire 110, a fluorine resin such as perfluoroalkoxy resin (PFA) excellent in heat resistance, chemical resistance, non-viscosity, self-lubricating properties, etc. is preferably used. The inner insulator 112 is formed by extruding this fluorine resin. The inner insulator 112 can be formed in, for example, a thickness of 0.08 mm and an outside diameter of 0.27 mm.

The outer conductor 113 of the large-diameter shielded electric wire 110 is formed by spirally winding plural tin-plated annealed copper alloy wires having a diameter of, for example, 0.03 mm around the inner insulator 112.

As the sheath 114 of the large-diameter shielded electric wire 110, a general resin tape of polyester, PTFE, etc. is used, and an outside diameter of the sheath 114 is, for example, 0.37 mm.

Each small-diameter shielded electric wire 120 has a central conductor 121, an inner insulator (insulating layer) 122, an outer conductor 123 and a sheath 124 from the center toward the outside in a cross section along the radial direction orthogonal to the central axis.

As the small-diameter shielded electric wire 120, for example, a shielded electric wire of AWG 44 in conformity with standards of AWG (American Wire Gauge), in which a cross-sectional area of the central conductor 121 is, for example, 0.01 $mm^2$ or less, is desirably used.

As the central conductor 121 of the small-diameter shielded electric wire 120, a twisted wire having an outside diameter of, for example, 0.063 mm formed by twisting seven silver-plated copper alloy wires having a diameter of, for example, 0.021 mm is used.

The inner insulator 122 of the small-diameter shielded electric wire 120 is formed by extruding a fluorine resin such as perfluoroalkoxy resin (PFA). A thickness of this inner insulator 122 is, for example, 0.05 mm, and an outside diameter of the inner insulator 122 is, for example, 0.16 mm.

The outer conductor 123 of the small-diameter shielded electric wire 120 is formed by spirally winding plural tin-plated annealed copper alloy wires having a diameter of, for example, 0.03 mm around the inner insulator 122.

As the sheath 124 of the small-diameter shielded electric wire 120, a general resin tape of polyester, PTFE, etc. is used, and an outside diameter of the sheath 124 is, for example, 0.25 mm.

Each large-diameter insulated electric wire 130 has a central conductor 131 covered with a covering 132 made of an insulating material. In the embodiment, as the large-diameter insulated electric wire 130, for example, an electric wire of AWG 32, in which a cross-sectional area of the central conductor 131 is 0.039 $mm^2$ or less, is used.

As the central conductor 131 of the large-diameter insulated electric wire 130, a twisted wire having an outside diameter of 0.26 mm formed by twisting twenty tin-plated annealed copper wires having a diameter of, for example, 0.05 mm is used.

The covering 132 of the large-diameter insulated electric wire 130 is formed by extruding a fluorine resin such as PFA. A thickness of this covering 132 is, for example, 0.06 mm, and an outside diameter of the covering 132 is, for example, 0.38 mm.

Each small-diameter insulated electric wires 140 has a central conductor 141 covered with a covering 142 made of an insulating material. In the embodiment, as the small-diameter insulated electric wire 140, for example, an electric wire of AWG 36 is used.

As the central conductor 141 of the small-diameter insulated electric wire 140, a twisted wire having an outside diameter of 0.15 mm formed by twisting seven tin-plated annealed copper wires having a diameter of, for example, 0.05 mm is used.

The covering 142 of the small-diameter insulated electric wire 140 is formed by extruding a fluorine resin such as PFA. A thickness of the covering 142 is, for example, 0.07 mm, and an outside diameter of the covering 142 is, for example, 0.28 mm.

As shown in FIG. 7, in the multi-core cable 101 of the embodiment, the plural (for example, two herein) small-diameter shielded electric wires 120 and at least one (for example, one herein) small-diameter insulated electric wire 140 are arranged in an inner layer and the plural (for example, five herein) large-diameter shielded electric wires 110 and the plural (for example, two herein) large-diameter insulated electric wires 130 are coaxially arranged in the periphery of the three electric wires of this inner layer in a cross section perpendicular to a length direction of the multi-core cable 101. Gaps between these electric wires may be provided with a filler such as aramid fibers or staple yarns.

The wrapping 102 is wrapped around the plural large-diameter shielded electric wires 110 and the plural large-diameter insulated electric wires 130 arranged in this manner and therefore, the electric wires are bundled without disturbing arrangement of each of the electric wires. The wrapping 102 is formed of, for example, a resin tape made of polyester.

The plural large-diameter shielded electric wires 110 and the plural large-diameter insulated electric wires 130 are covered with the overall shielding layer 103 through the wrapping 102. The overall shielding layer 103 is formed by singly braiding plural tin-plated annealed copper alloy wires having a diameter of, for example, 0.03 mm on the wrapping 102.

The outer periphery of this overall shielding layer 103 is covered with the cable sheath 104. The cable sheath 104 is formed by extruding a fluorine resin made of, for example, black PFA. An outside diameter of this cable sheath 104 is, for example, 1.7 mm.

As the cable sheath 104, a resin tape of polyester etc. may be wrapped around the overall shielding layer 103 instead of the fluorine resin.

Figure 8:
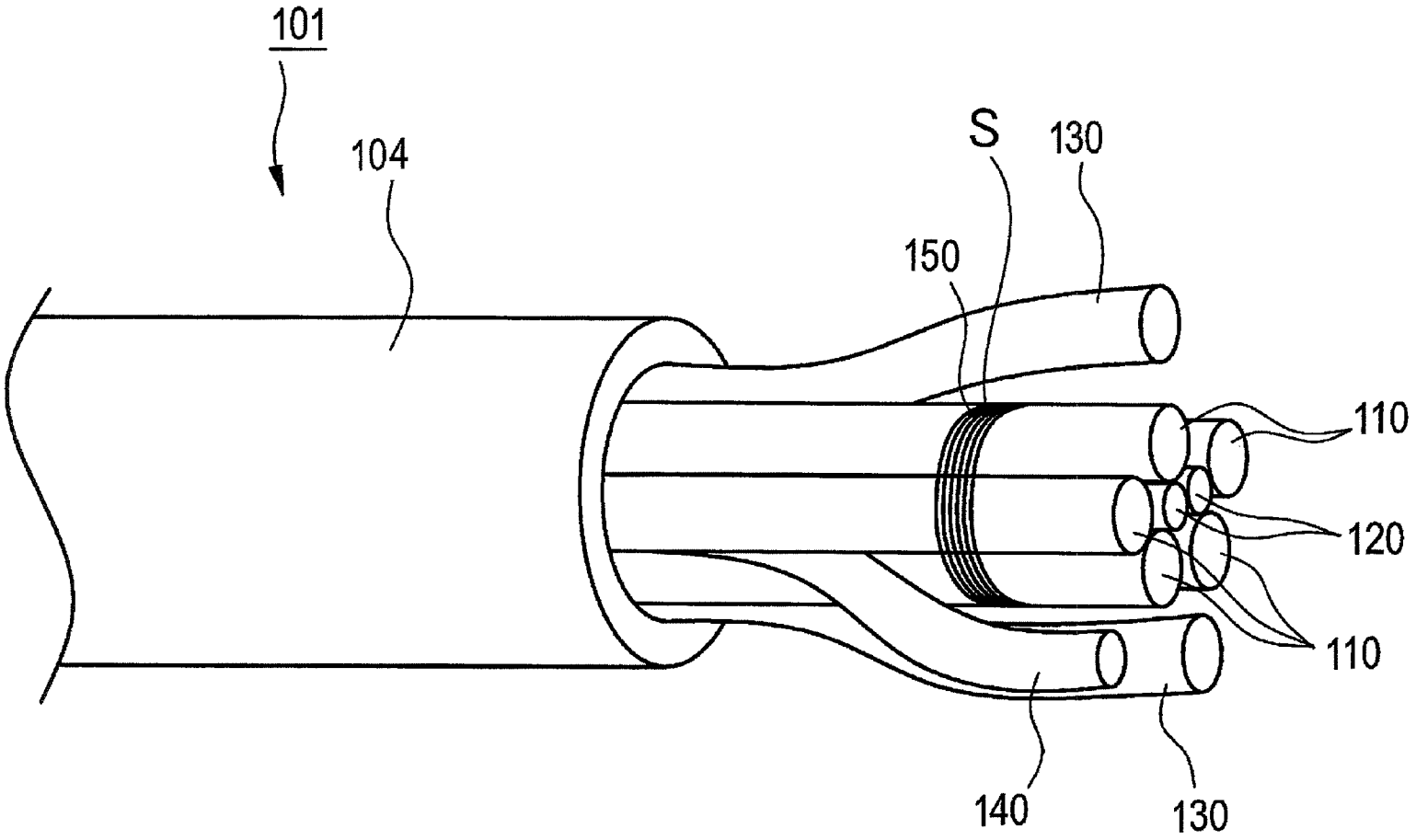
FIG. 8 is a perspective view showing one example of distal end processing of the multi-core cable shown in FIG. 7.

As shown in FIG. 8, in the end of the multi-core cable 101 of the embodiment, the cable sheath 104 is removed by laser processing etc. The sheaths 114 of the large-diameter shielded electric wires 110 and the sheaths 124 of the small-diameter shielded electric wires 120 are further removed at the same position in the axial direction (length direction) along, for example, a length of about 1 to 5 mm, respectively. At its removed position, conductors of the shielded electric wires (that is, the outer conductors 113 of the large-diameter shielded electric wires 110 and the outer conductors 123 of the small-diameter shielded electric wires 120) are in once an exposed state.

The plural large-diameter shielded electric wires 110 and the plural small-diameter shielded electric wires 120 with the outer conductors 113 and the outer conductors 123 respectively exposed to a part of the axial direction are bundled cylindrically. Specifically, a metal wire 150 having a diameter of, for example, 0.03 to 0.1 mm winds around a position at which the outer conductors 113 and the outer conductors 123 are exposed. The plural large-diameter shielded electric wires 110 and the plural small-diameter shielded electric wires 120 are wholly tightened and bundled by the metal wire 150 in the outer conductors 113 and the outer conductors 123 exposed. It may be configured to wind the metal wire 150 and then wrap a metal tape etc. around the metal wire 150. In an example shown in FIG. 8, the large-diameter insulated electric wires 130 and the small-diameter insulated electric wire 140 are not bundled by the metal wire 150.

The metal wire 150 winding around the outer conductors 113 and the outer conductors 123 is fastened to the outer conductors 113 and the outer conductors 123 by low-melting-point solder S having a melting temperature of 130 to 150° C. As this solder S, lead-free solder is preferably used from the standpoint of handling. The melting temperature of this solder S is obtained from the maximum endothermic point in a DSC curve of a differential scanning calorimetry.

Instead of this low-melting-point solder, a conductive adhesive made of, for example, a material in which metal particles are mixed with an epoxy resin can be used.

As shown in FIG. 8, even when the small-diameter shielded electric wires 120 get in the large-diameter shielded electric wires 110, the outer conductors 113 of the large-diameter shielded electric wires 110 are tightened by the metal wire 150 and thereby, the outer conductors 113 of the large-diameter shielded electric wires 110 make contact with the outer conductors 123 of the small-diameter shielded electric wires 120 to obtain electrical connection between the outer conductors 113 and the outer conductors 123. The large-diameter shielded electric wires 110 and the small-diameter shielded electric wires 120 which are the shielded electric wires for signal transmission can be grounded to a substrate or a connector at any position through the metal wire 150.

According to such a configuration, an outside diameter of the portion in which the outer conductors 113 of the large-diameter shielded electric wires 110 and the outer conductors 123 of the small-diameter shielded electric wires 120 are exposed and are bundled by the metal wire 150 and are fastened by the solder S is, for example, 1.3 mm, and becomes smaller than an outside diameter (1.7 mm) of the multi-core cable 101.

In the multi-core cable 101, respective conductor resistances, insulation resistances, dielectric strengths, characteristic impedances and allowable currents of the large-diameter shielded electric wire 110, the small-diameter shielded electric wire 120, the large-diameter insulated electric wire 130 and the small-diameter insulated electric wire 140 were measured.

As a result, in the large-diameter shielded electric wire 110, for example, the conductor resistance was a maximum of 3300 Ω/Km, and the insulation resistance was 1524 MΩ/Km or more, and the dielectric strength was 500 ACV/min, and the characteristic impedance was 50 Ω±5.

In the small-diameter shielded electric wire 120, for example, the conductor resistance was a maximum of 10000 Ω/Km, and the insulation resistance was 1524 MΩ/Km or more, and the dielectric strength was 500 ACV/min, and the characteristic impedance was 50Ω±5.

In the large-diameter insulated electric wire 130, for example, the conductor resistance was a maximum of 600 Ω/Km, and the insulation resistance was 1524 MΩ/Km or more, and the dielectric strength was 500 ACV/min, and the allowable current was a maximum of 1.2 A.

In the small-diameter insulated electric wire 140, for example, the conductor resistance was a maximum of 1540 Ω/Km, and the insulation resistance was 1524 MΩ/Km or more, and the dielectric strength was 500 ACV/min, and the allowable current was a maximum of 0.7 A.

This could check that the multi-core cable 101 according to the embodiment has sufficiently practicable electrical characteristics.

wherein the position at which the metal wire winds is fastened to each of the outer conductors by solder having a melting temperature of 130 to 150° C., and wherein an outside diameter of the position at which the metal wire winds and the shielded electric wires are fastened by the solder is smaller than an outside diameter of the cable sheath.

The multi-core cable 101 according to the embodiment can make an outside diameter of the position at which the metal wire 150 is fastened by the solder S smaller than an outside diameter of the multi-core cable 101. The outside diameter of the multi-core cable becomes locally large through the whole length thereof. As a result, when the multi-core cable 101 is used as a wiring member of a medical device such as an endoscope or a catheter inserted into the body of a patient, an invasiveness to the patient can be reduced in the case of inserting the medical device into the body of the patient.

Since the metal wire 150 winding around the outer conductors 113 and the outer conductors 123 is fastened to the outer conductors 113 and the outer conductors 123 by low-melting-point solder having a melting temperature of 130 to 150° C., deterioration of the insulating layers 112, 122 can be prevented.

Also when both of the shielded electric wires for signal transition and the insulated electric wires for signal transmission are bundled by the metal wire 150, handling is simple and it is easy to manufacture the multi-core cable 101.

Third Embodiment

Next, a multi-core cable 101*a* according to a third embodiment of the invention will be described. Since the multi-core cable 101*a* of the third embodiment shown in FIG. 9 is a modified example of the second embodiment described above, the description is omitted by assigning the same numerals to the same members.

Figure 9:
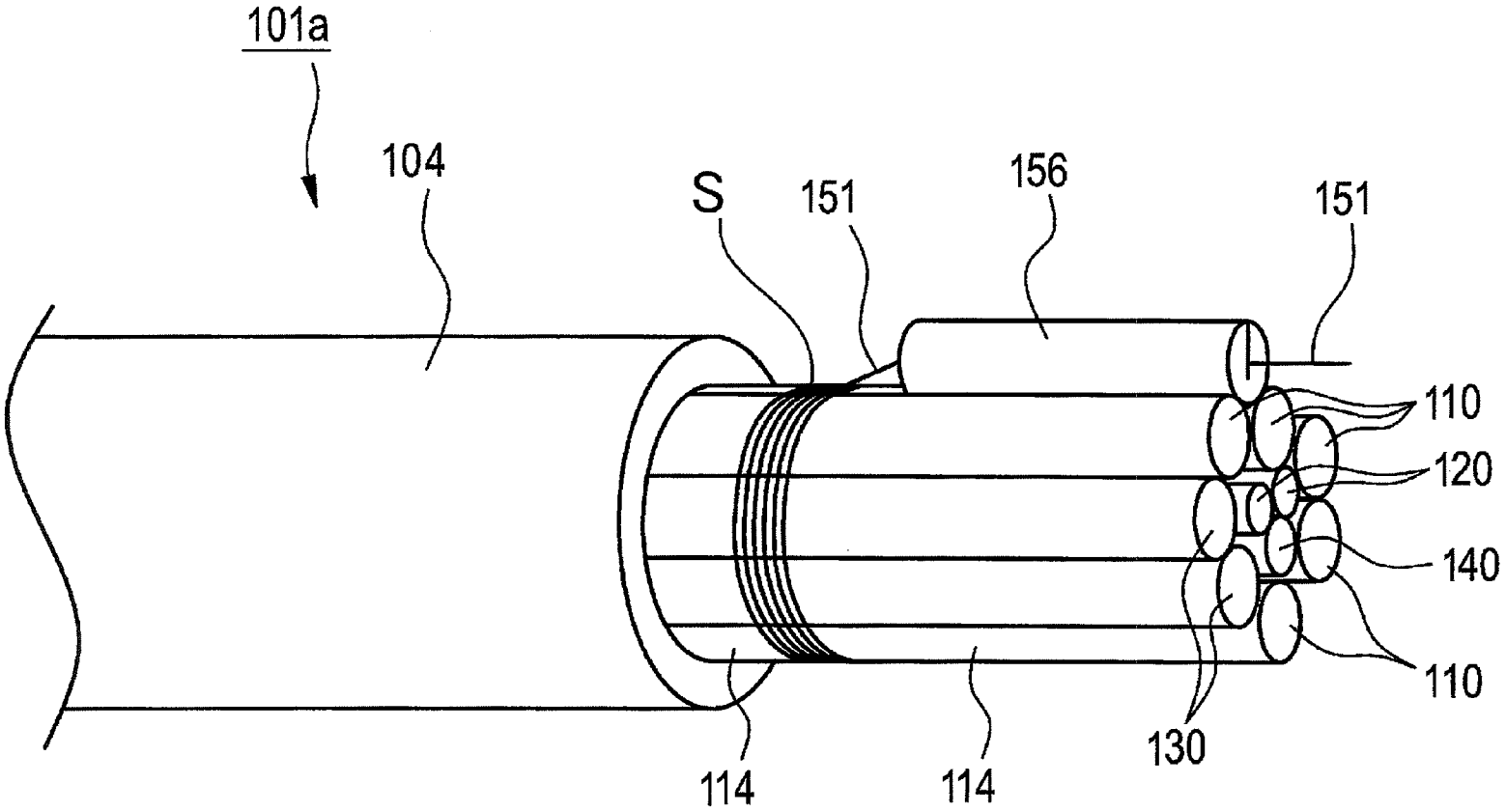
FIG. 9 is a perspective view showing an example of distal end processing of a multi-core cable according to a third embodiment of the invention.

As shown in FIG. 9, in the end of the multi-core cable 101*a* of the third embodiment, a cable sheath 104 is removed by laser processing etc. Sheaths 114 of large-diameter shielded electric wires 110 and sheaths 124 of small-diameter shielded electric wires 120 are removed at the same position in the axial direction along, for example, a length of about 1 to 5 mm, respectively, and at its position, outer conductors 113 of the large-diameter shielded electric wires 110 and outer conductors 123 of the small-diameter shielded electric wires 120 are in an exposed state.

The outer conductors 113, 123 exposed in this manner are wholly bundled by a metal wire 151 together with coverings 132 of large-diameter insulated electric wires 130 and a covering 142 of a small-diameter insulated electric wire 140.

As the metal wire 151 of the embodiment, for example, a metal wire having a diameter of 0.03 to 0.1 mm can be adopted. This metal wire 151 is provided with an insulating part 156 made of an insulating material covering a part of the metal wire 151 in the length direction.

Both ends of this metal wire 151 are exposed from the insulating part 156. The metal wire 151 of one end exposed from the insulating part 156 winds so as to wholly bundle the outer conductors 113, 123 and the coverings 132, 142. The metal wire 151 exposed to the other end can be used in connection to a ground terminal of a connector or a substrate (not shown).

The insulating part 156 arranged in the center in the length direction of the metal wire 151 is arranged in parallel with the sheaths 114 of the plural large-diameter shielded electric wires 110 or the coverings 132 of the plural large-diameter insulated electric wires 130.

The metal wire 151 winding around the outer conductors 113, 123 and the coverings 132, 142 is fastened by low-melting-point solder having a melting temperature of 130 to 150° C.

The metal wire 151 winding around the outer conductors 113, 123 and the coverings 132, 142 in one end side preferably has a length about 1.5 to 5 times the circumference of the portion in which the outer conductors 113, 123 and the coverings 132, 142 are bundled. The insulating part 156 preferably has, for example, a length of about 1 to 5 mm.

According to such a configuration, an outside diameter of the portion bundled by the metal wire 151 and fastened by solder S is, for example, 1.5 mm, and can be made smaller than an outside diameter (1.7 mm) of the multi-core cable 101*a*.

In the multi-core cable 101*a* according to the embodiment, the metal wire 151 has the insulating part 156 of the insulating material covering a part of the metal wire 151. Each of the outer conductors 113, 123 is wholly bundled by the metal wire 151 exposed from the insulating part 156, and the insulating part 156 is arranged in parallel with each of the sheaths 114, 124.

This insulating part 156 can mechanically protect the metal wire 151, and can also prevent the metal wire 151 from being short-circuited by making contact with the shielded electric wires 110, 120 for signal transmission or the insulated electric wires 130, 140 for signal transmission arranged in parallel.

The examples of the embodiments of the invention have been described above, but the invention is not limited to the embodiments described above, and can adopt other configurations as necessary.

The multi-core cable 101*a* shown in FIG. 9 is configured to bundle the large-diameter insulated electric wires 130 and the small-diameter insulated electric wire 140 together with the large-diameter shielded electric wires 110 and the small-diameter shielded electric wires 120 by the metal wire 151, but it may be configured to bundle and tighten only the large-diameter shielded electric wires 110 and the small-diameter shielded electric wires 120 by the metal wire 151 depending on use of the multi-core cable 101*a*.

The number of shielded electric wires and ground electric wires is not limited to the embodiments described above. That is, the multi-core cable can include a necessary number of shielded electric wires and ground electric wires according to usage environment etc. It is unnecessary for the multi-core cable to include the ground electric wire.

In order to improve electrical characteristics, processing of metal plating or wrapping by a metal tape may be performed on surfaces of the sheaths 114, 124 and the coverings 132, 142.

In the second and third embodiments described above, the large-diameter shielded electric wires 110 are not limited to the example shown in FIG. 7.

Figure 10A:
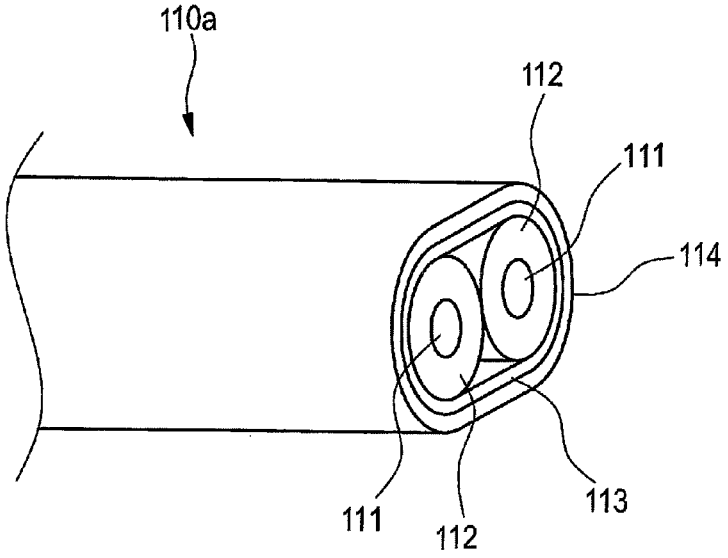
FIGS. 10A and 10B are perspective views showing modified examples of the shielded electric wire according to the invention.
Figure 10B:
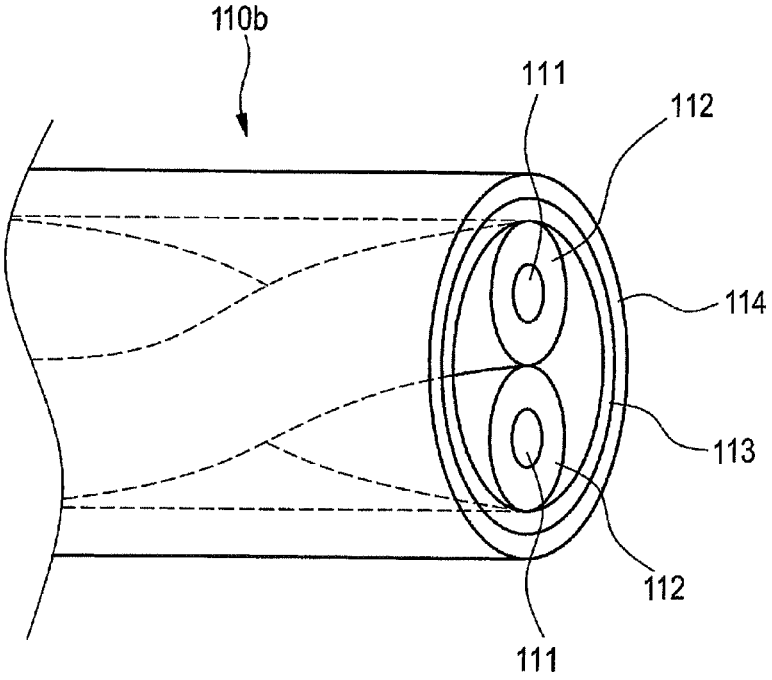

For example, as shown in FIGS. 10A and 10B, large-diameter shielded electric wires 110*a*, 110*b* may be configured as a two-core parallel wire (FIG. 10A) and a twisted pair wire (FIG. 10B) in which two central conductors 111 covered with inner insulators 112 are arranged adjacently and the outer periphery of the inner insulators 112 is wholly covered with an outer conductor 113. The same applies to the small-diameter shielded electric wires 120. Also in this case, work and effect similar to those of the embodiments described above can be obtained.

Multi-core cables using the large-diameter shielded electric wires 110*a*, 110*b* shown in FIGS. 10A and 10B have the following configuration.

Plural shielded electric wires for signal transmission are covered with a cable sheath. Each shielded electric wire has plural central conductors having cross-sectional area of 0.01 $mm^2$ or less, respectively, insulating layers covering the plural central conductors, respectively, an outer conductor wholly covering the insulating layers, and a sheath covering the outer conductor. In the end of the multi-core cable, the cable sheath is removed along a given length to expose the plural shielded electric wires. Each of the sheaths of the plural shielded electric wires is removed at the same position in the length direction to expose each of the outer conductors. A metal wire wholly winds around each of the outer conductors so as to tighten and bundle each of the exposed outer conductors. The winding portion of the metal wire is fastened to the outer conductors by solder S having a melting temperature of 130 to 150° C. An outside diameter of the winding portion of the metal wire fastened by the solder is smaller than an outside diameter of the cable sheath.

In the multi-core cables using the large-diameter shielded electric wires 110*a*, 110*b* shown in FIGS. 10A and 10B, the metal wire 151 provided with the insulating part 156 may be wholly wind around each of the outer conductors so as to tighten and bundle each of the exposed outer conductors by the metal wire 151 provided with the insulating part 156 as shown in FIG. 9.

The invention has been described in detail with reference to the specific embodiments, but it is apparent to those skilled in the art that various changes or modifications can be made without departing from the spirit and scope of the invention.

The invention claimed is:

1. A multi-core cable including plural shielded electric wires for signal transmission, and a ground electric wire made of an insulated electric wire or a shielded electric wire, wherein the shielded electric wires are arranged in two circular layers in a cross section perpendicular to a length direction of the cable, wherein sheaths of all of the plural shielded electric wires are respectively removed to exposed outer conductors, and a sheath of the ground electric wire is removed to expose a conductor, at the same position in a length direction, wherein the exposed outer conductors of the plural shielded electric wires and the exposed conductor of the ground electric wire are bundled by a metal wire, and the bundled portion is soldered and fastened, and wherein the ground electric wire is drawn out from the bundled and soldered portion only toward one side.

2. The multi-core cable of claim 1, wherein the ground electric wire is a shielded electric wire, wherein the sheath of the ground electric wire is removed to expose an outer conductor at the same position in the length direction as the position at which the sheaths of the shielded electric wires for signal transmission are removed, and wherein the metal wire winds around the outer conductors of the plural shielded electric wires and the outer conductor of the ground electric wire to thereby bundle the plural shielded electric wires and the ground electric wire, and the bundled portion is soldered and fastened.

3. The multi-core cable of claim 1, wherein the plural shielded electric wires are covered with a cable sheath, wherein each shielded electric wire has a central conductor having a cross-sectional area of 0.01 mm2 or less, an insulating layer covering the central conductor, the outer conductor covering the insulating layer, and the sheath covering the outer conductor, wherein, in an end of the multi-core cable, the cable sheath is removed along a given length to expose the plural shielded electric wires, wherein each of the sheaths of the plural shielded electric wires is removed at the same position in the length direction to expose each of the outer conductors, wherein the metal wire wholly winds around the outer conductors so as to tighten and bundle the exposed outer conductors, wherein the position at which the metal wire winds is fastened to each of the outer conductors by solder having a melting temperature of 130 to 150° C., and wherein an outside diameter of the position at which the metal wire winds and the shielded electric wires are fastened by the solder is smaller than an outside diameter of the cable sheath.

4. The multi-core cable of claim 3, wherein the multi-core cable further includes plural insulated electric wires for signal transmission, wherein each insulated electric wire has a central conductor having an area of 0.01 mm2 or less, and a covering covering the central conductor, and wherein the plural insulated electric wires are bundled together with all the outer conductors of the plural shielded electric wires by the metal wire.

5. A multi-core cable including plural shielded electric wires for signal transmission, wherein the plural electric wires are arranged in two circular layers in a cross section perpendicular to a length direction, wherein sheaths of all of the plural shielded electric wires are respectively removed to exposed outer conductors, at the same position in a length direction, wherein the exposed outer conductors of the plural shielded electric wires are bundled by a metal wire, and the bundled portion is soldered and fastened, wherein a part of the metal wire is covered with an insulating part of an insulating material, wherein the exposed outer conductors are wholly bundled by another part of the metal wire than the part covered with the insulating part, and wherein the insulating part is arranged in parallel with the sheaths of the plural shielded electric wires exposed from the cable sheath.

6. The multi-core cable of claim 1, wherein the plural shielded electric wires are covered with a cable sheath, wherein each shielded electric wire has plural central conductors having cross-sectional area of 0.01 mm2 or less, respectively, plural insulating layers covering the plural central conductors, respectively, an outer conductor wholly covering the insulating layers, and a sheath covering the outer conductor, wherein, in an end of the multi-core cable, the cable sheath is removed along a given length to expose the plural shielded electric wires, wherein each of the sheaths of the plural shielded electric wires is removed at the same position in the length direction to expose each of the outer conductors, wherein the metal wire wholly winds around the outer conductors so as to tighten and bundle the exposed outer conductors, wherein the position at which the metal wire winds is fastened to each of the outer conductors by solder having a melting temperature of 130 to 150° C., and wherein an outside diameter of the position at which the metal wire winds and the shielded electric wires are fastened by the solder is smaller than an outside diameter of the cable sheath.

7. The multi-core cable of claim 6, wherein the multi-core cable further includes plural insulated electric wires for signal transmission, wherein each insulated electric wire has a central conductor having a cross-sectional area of 0.01 $mm^2$ or less, and a covering covering the central conductor, and wherein the plural insulated electric wires are bundled together with all the outer conductors of the plural shielded electric wires by the metal wire.

* * * * *